United States Patent [19]

Beamer

[11] Patent Number: 4,945,951

[45] Date of Patent: Aug. 7, 1990

[54] TEMPORARY PLUG FOR FLUID FITTING

[75] Inventor: Henry E. Beamer, Middleport, N.Y.

[73] Assignee: General Motors Corporation, Detroit, Mich.

[21] Appl. No.: 261,308

[22] Filed: Oct. 24, 1988

[51] Int. Cl.[5] ..... B65D 51/00

[52] U.S. Cl. ..... 138/89; 138/96 T

[58] Field of Search ..... 138/89, 96 R, 96 T

[56] References Cited

U.S. PATENT DOCUMENTS

| | | | |
|---|---|---|---|
| 1,674,998 | 6/1928 | Spang | 138/96 R |
| 3,148,798 | 9/1964 | Brown | 138/89 |
| 3,821,969 | 7/1974 | Sinko | 138/89 |
| 3,828,968 | 8/1974 | Kask | 138/89 |
| 3,870,084 | 3/1979 | Gezari | 138/89 |
| 3,893,487 | 7/1975 | Engelking | 138/89 |
| 4,046,168 | 9/1977 | Milne | 138/89 |
| 4,333,891 | 6/1982 | Miller | 138/89 |
| 4,526,275 | 7/1985 | Nixon | 138/89 |

FOREIGN PATENT DOCUMENTS

| | | | |
|---|---|---|---|
| 1164847 | 10/1958 | France | 138/96 R |

*Primary Examiner*—James E. Bryant, III

*Attorney, Agent, or Firm*—Ronald L. Phillips

[57] ABSTRACT

A dust plug adapted to be retained by and sealed to the O-ring in a fluid fitting. The plug has a spherical insertion end and a shoulder remote therefrom and is retained by the O-ring between the bead and the shoulder on insertion of the plug with the shoulder also acting as a stop against the O-ring to prevent over insertion.

2 Claims, 1 Drawing Sheet

TEMPORARY PLUG FOR FLUID FITTING

Technical Field

This invention relates to temporary plugs for fluid fittings and more particularly to a temporary plug for a fluid fitting that employs an O-ring seal.

Background of the Invention

In fluid devices such as oil cooler assemblies intended for installation in motor vehicle radiators, it is common practice to employ a plastic plug termed a "dust" plug to prevent contamination of the oil cooler through its fittings by dust and dirt during radiator assembly, shipping and storage. Such oil coolers typically have internal threaded fittings, i.e. female fittings, and the plugs are retained in these oil cooler fittings by means of ridges molded in the side of the plug which engage in the inside thread of the fitting. While such a plug adequately protects the oil cooler against solid contaminants, it must be replaced with a water tight plug such as a threaded plug if the radiator requires an air underwater leak check during repair operations. On the other hand, there is now a movement toward quick connect oil cooler fittings which employ one or more O-rings for sealing in which event no internal feature such as a helical thread is normally available for the molded ridges to engage. As a result, it has been proposed to provide a cap with an internal or external thread but which then requires a complimentary provision on the quick connect fitting that further complicates same and can add significant cost.

Summary of the Present Invention

The present invention offers a simple cost effective solution to providing a water tight seal as well as a dust plug to seal an O-ring fluid fitting. In the typical O-ring fitting, the O-ring is normally retained in a internal groove in the female half and projects slightly radially inwardly thereof to sealingly contact with the male counterpart upon insertion of the later. The plug according to the present invention is formed with a rounded bead on the terminal or insertion end and a shoulder spaced rearwardly thereof. Upon insertion, the plug is retained by the O-ring between the bead and shoulder with the later also acting as a stop against the O-ring to prevent over insertion. And a relatively light interference fit is provided between the plug body and the O-ring to provide the proper water tight seal. In addition, the plug is provided with an extension at its outboard end which may be simply grasped with a standard hand tool to assist in the removal of the plug.

Thus, the temporary plug of the present invention provides a water tight seal which eliminates the need to replace one plug with a different one for an air underwater leak check. Furthermore, where the O-ring fitting is on a device such as an oil cooler, the installation of same in a radiator tank is not affected because the temporary plug is housed completely within the oil cooler fitting. Moreover, removal of the temporary plug is easily accomplished with standard tools such as pliers with no interference experienced with any projections of the quick connect fitting due to the small outside diameter of the plug. In addition, the temporary plug configuration as will be described in greater detail later facilitates automatic feed and installation equipment. And the temporary plug is reusable and of especially low cost.

These and other objects, advantages and features of the invention will be more apparent from the following description and drawing in which:

Description of a Preferred Embodiment

Figure 1:
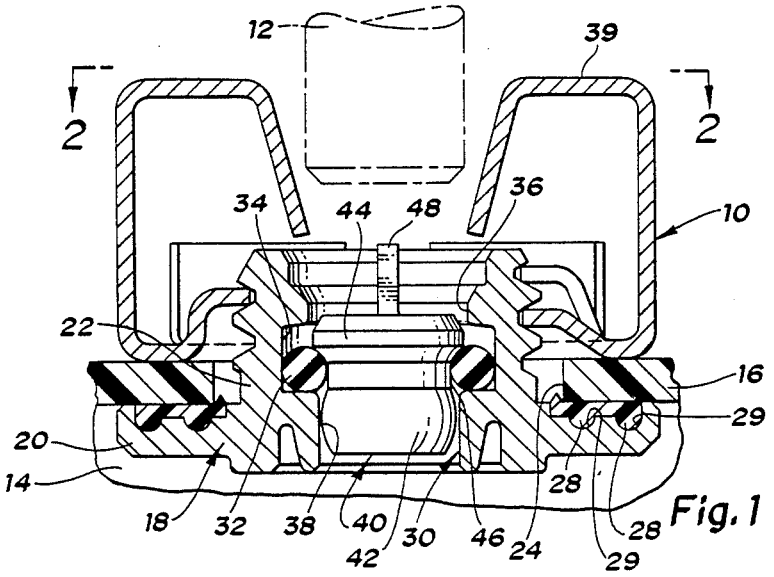
FIG. 1 is a cross-sectional view of an O-ring fitting having a dust plug according to the present invention inserted therein.
Figure 2:
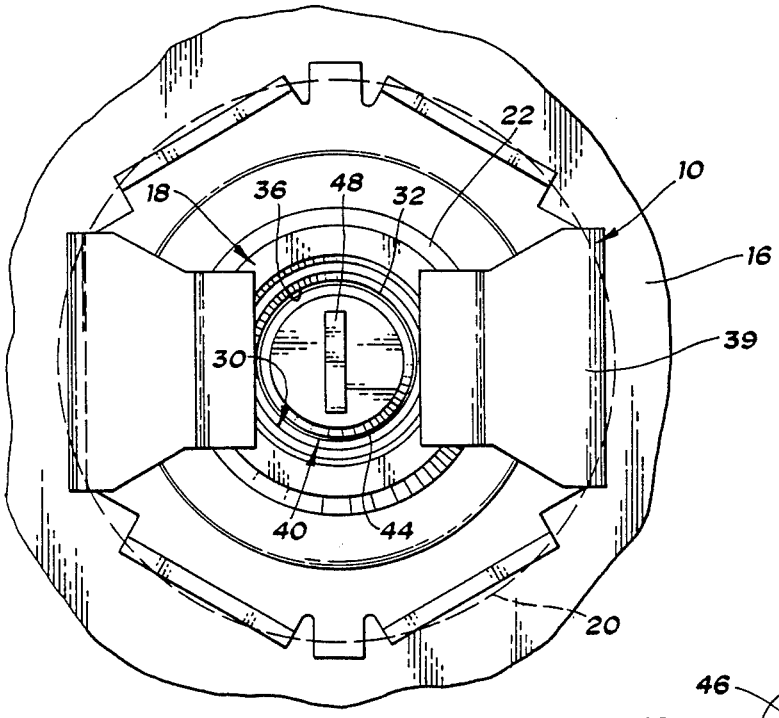
FIG. 2 is a view taken on the line 2—2 of FIG. 1.
Figure 3:
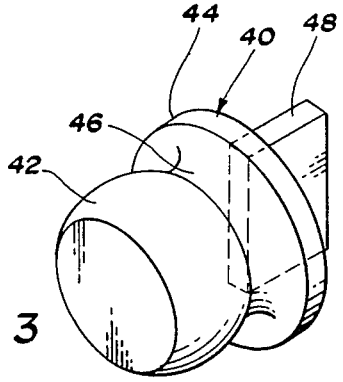
FIG. 3 is an enlarged isometric view of the dust plug in FIGS. 1 and 2.

Referring to the drawings wherein the same numbers are used throughout the several views to identify the same or similar parts, there is shown an O-ring fitting of the quick connect tube coupling type which is designated as 10 and is adapted to quickly connect one end of a tube 12 (shown in phantom line) to the interior 14 of a liquid vessel through its walls 16. And it will also be understood that the coupling may be also connected within the vessel to another vessel such as for example an automatic transmission oil cooler within a tank of a motor vehicle engine radiator.

The quick connect tube coupling 10 comprises a connector body 18 having a cylindrical head portion 20 that is located within the vessel and an externally threaded concentric portion 22 of smaller diameter that is received by and extends upwardly through an opening 24 in the vessel wall 16. The cylindrical portion 20 is sealed to the vessel with two integral O-rings 28 mounted in grooves 29 in the upper face of portion 20 on tightening of the fitting. In addition, the connector body has a central axially extending opening 30 extending therethrough and an O-ring 32 of circular cross-section is mounted in a radially outwardly extending internal annular groove 34 formed in the wall defining this opening immediately the ends thereof. The opening 30 looking inwardly (downwardly in the views) has cylindrical lands 36 and 38 of large and small diameter respectively on opposite sides of the O-ring. And a one-piece nut and tube retainer member 39 made of sheet metal threadable engages the fitting portion 22 to tighten the connector body 20 against the vessel and in addition provide for subsequent retention of the tube 12 following its insertion. Such retention as well as further details of the fitting apart from the dust plug are disclosed in detail in applicants U.S. Pat. No. 4,756,558 issued July 12, 1988 and hereby incorporated by reference.

An imperforate temporary plug 40 preferably molded of plastic is adapted to be retained by and sealed to the O-ring when installed as shown in FIG. 1. The plug has a chamfered or ramped insertion end preferably in the form of a spherical or rounded shape as shown and an annular shoulder 44 of slightly larger diameter spaced rearwardly thereof and arranged coaxial therewith. The rear side of the head 42 and the front side of the shoulder 44 define an external annular groove 46 on the plug adapted to accommodate the O-ring 32. The round shaped head 42 allows for smooth insertion of the bead past the O-ring whereafter the plug is then retained by the O-ring between this bead and the shoulder 44. Moreover, the diameter of the shoulder 44 is slightly larger than that of the cylindrical land 38 so that the shoulder also acts as a stop against the O-ring to prevent over insertion of the plug while being accommodated by the larger diameter land 36.

A predetermined light interference fit between the plug body and the O-ring provides a water tight seal and in addition allows the plug with again the aid of its spherical surface 42 to be readily removed from the fitting with only a few pounds pulling force. The latter is accomplished by simply grasping a rectangular shaped withdrawal tab 48 formed on the exterior or rear end of the plug with such tab extending centrally axially therefrom so as to be adapted to be grasped and pulled by standard needle nose pliers or other like standard tools. However, it will also be understood that while the tab is preferably of polygon shape as shown, it may have other forms such as a cylindrical shape that could be readily grasped by for example a cylindrical collet type tool. Furthermore, it will be seen that the plastic plug is not beyond the outer diameter of the fitting and instead totally within the interior of the fitting. As a result there is no interference where such fitting must be received through an opening in a vessel such as the case shown in FIG. 1. Furthermore, the temporary plug configuration is such that it requires only an axial force which is readily accomplished with automatic feed and installation type equipment.

The foregoing description of a preferred embodiment of the invention has been presented for purposes of illustration and description. It is not intended to be exhausted or to limit the invention to the precise form disclosed. Obvious modifications or variations are possible in light of the above teachings. The embodiment was chosen and described to provide the best illustration of the principles of the invention and its practicable application to thereby enable one of ordinary skill in art to utilize the invention in various embodiments and with various modifications as are suited to the particular use contemplated. All such modifications and variations are within the scope of the invention as determined by the appended claims when interpreted in accordance with the breath to which they are fairly, legally and equitably entitled.

The embodiments of the invention in which an exclusive property or privilege is claimed are defined as follows:

1. In combination, a female fluid fitting having an internal annular groove, an O-ring mounted in said internal groove for normally sealingly contacting with a male fitting on insertion of the latter into said female fitting, and a temporary plug closing said female fitting comprising an imperforate body inserted into said female fitting, said body having a rounded insertion ramp end and an annular shoulder axially spaced therefrom and arranged coaxial therewith so as to define an external annular groove, said rounded insertion ramp end constituting a means to slidably receive said O-ring in said external groove and to sealingly receive said O-ring, said O-ring constituting a means to sealingly close said plug to said female fitting and also readily releasably retain said plug in place with said O-ring and said shoulder adapted to act as a stop against said O-ring to prevent over insertion of said plug.

2. In combination, a female fluid fitting having an internal annular groove, an O-ring mounted in said internal annular groove for normally sealingly contacting with a male fitting such as a tube on insertion of the latter into said female fitting, and a temporary plug closing said female fitting comprising an imperforate body inserted into said female fitting, said body having a rounded insertion ramp end and an external annular groove adapted to sealingly receive said O-ring, said rounded insertion ramp end constituting a means to slidably receive said O-ring in said external annular groove to sealingly close said plug to said female fitting and also readily releasably retain said plug in place with said O-ring, said plug further having means in the form of a projecting solid polygon shaped withdrawal tab accessible from exterior of the female fitting adapted for grasping such as with pliers to effect removal of the plug.

* * * * *